US005561889A

United States Patent [19]

Leifeld

[11] Patent Number: 5,561,889

[45] Date of Patent: Oct. 8, 1996

[54] METHOD AND APPARATUS FOR ALTERING ANGULAR VELOCITY OF A COILER HEAD

[75] Inventor: Ferdinand Leifeld, Kempen, Germany

[73] Assignee: Trützschler GmbH & Co. KG, Mönchengladbach, Germany

[21] Appl. No.: 460,201

[22] Filed: Jun. 2, 1995

[30] Foreign Application Priority Data

Aug. 11, 1994 [DE] Germany ..... 44 28 476.4

[51] Int. Cl.[6] ..... B65H 54/80

[52] U.S. Cl. ..... 19/159 R

[58] Field of Search ..... 19/159 R, 159 A, 19/160; 57/400

[56] References Cited

U.S. PATENT DOCUMENTS

| | | | |
|---|---|---|---|
| 4,400,854 | 8/1983 | Socha | 19/159 R |
| 4,561,151 | 12/1985 | Schöpwinkel | 19/159 R |
| 5,274,884 | 1/1994 | Demuth et al. | 19/159 R X |
| 5,428,869 | 7/1995 | Holubec et al. | 19/159 R |

FOREIGN PATENT DOCUMENTS

| | | | |
|---|---|---|---|
| 0064584 | 11/1982 | European Pat. Off. | 19/159 R |
| 0123839 | 11/1984 | European Pat. Off. . | |
| 2802216 | 7/1979 | Germany | 19/159 R |
| 2913450 | 10/1980 | Germany . | |
| 4035876 | 6/1991 | Germany . | |
| 9320355 | 9/1994 | Germany . | |
| 0017864 | 2/1981 | Japan | 19/159 R |
| 1272669 | 5/1972 | United Kingdom . | |
| 92/04266 | 3/1992 | WIPO . | |

*Primary Examiner*—Ismael Izaguirre
*Attorney, Agent, or Firm*—Spencer & Frank

[57] ABSTRACT

An apparatus for depositing sliver from a sliver-producing machine into a coiler can in an annular pattern includes two cooperating pressure rolls for advancing the sliver; a rotatably supported coiler head arranged for receiving sliver from the pressure rolls and having a sliver outlet travelling in a circular path upon rotation of the coiler head; a movable coiler can platform disposed below the coiler head for receiving a coiler can in an upright position; a drive for driving the pressure rolls, the coiler head and the coiler can platform for advancing sliver from the pressure rolls into the coiler head and for depositing sliver by the circulating sliver outlet into the coiler can moved by the coiler can platform in an annular pattern; and a control and regulating device connected to the drive for altering the angular velocity of the coiler head within revolutions thereof as a function of momentary positions of the sliver outlet on the circular path thereof.

10 Claims, 5 Drawing Sheets

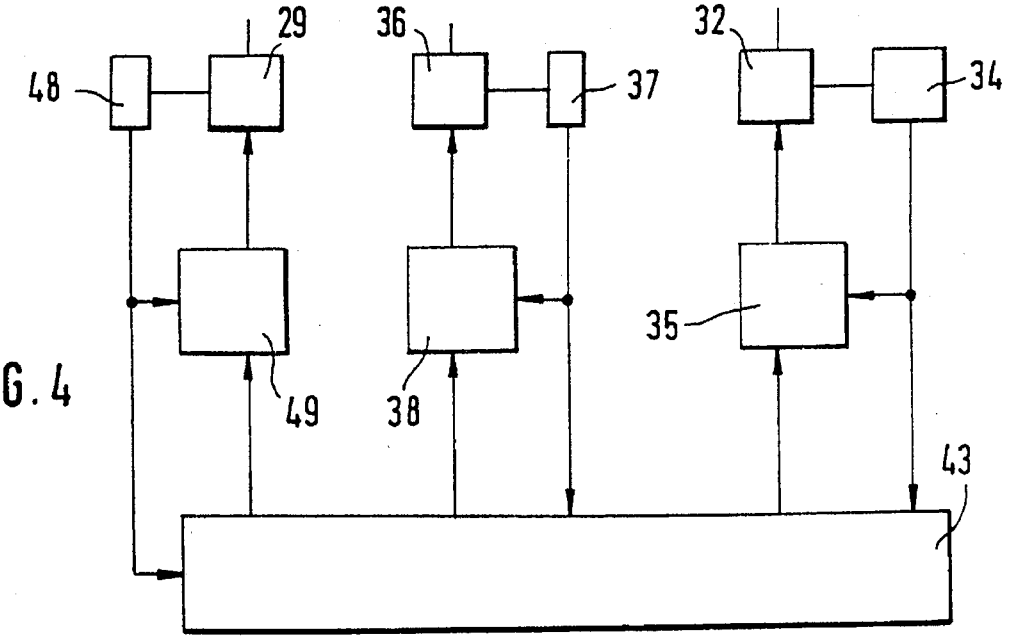
FIG. 4
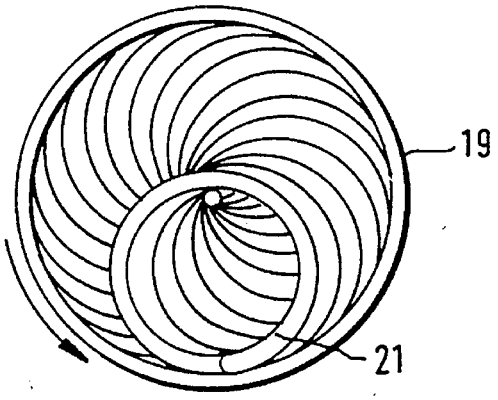
FIG. 5
FIG. 6
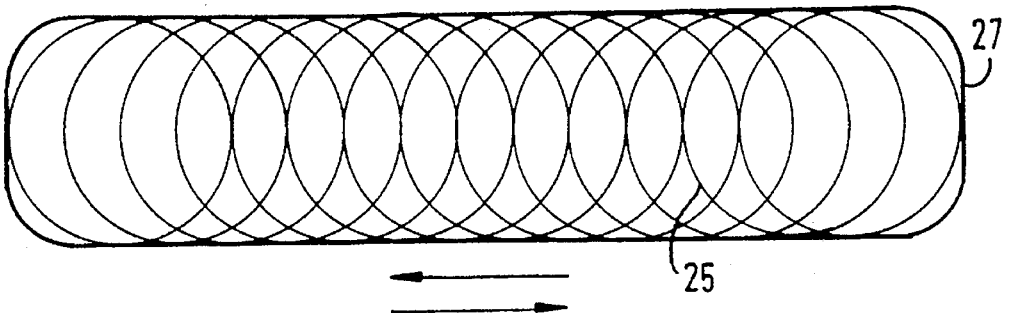

METHOD AND APPARATUS FOR ALTERING ANGULAR VELOCITY OF A COILER HEAD

CROSS-REFERENCE TO RELATED APPLICATION

This application claims the priority of German Application No. P 44 28 476.4 filed Aug. 11, 1994, which is incorporated herein by reference.

BACKGROUND OF THE INVENTION

This invention relates to a method and an apparatus for depositing a textile sliver from a sliver-producing machine, particularly a drawing frame, into a coiler can. The sliver is advanced by pressure rolls to a rotary coiler head which deposits the sliver in an annular pattern into a coiler can which is situated underneath the coiler head and moved during sliver deposition. The coiler head has its own driving device and its rotation is regulated.

In a known method mechanically mutually independent electric motors are provided for driving the sliver advancing pressure rolls, the coiler head for the epicycloidal deposition of the sliver into a coiler can and for moving the coiler can platform. The electric motors are connected in series. It is a disadvantage of such a known method that the rpm of the coiler head may not be altered by itself. Given the same angular velocities, problems may be encountered in the sliver deposition because the direction of rotation upon each revolution, that is, deposition of one sliver coil is oriented in the direction as well as opposite the direction of the can motion. In this manner, in each instance a lag change is experienced during the deposition of the sliver coil. These problems are compounded at high sliver delivery speeds when the pressure rolls and the coiler head rotate at elevated rpm's.

SUMMARY OF THE INVENTION

It is an object of the invention to provide an improved method and apparatus of the above-outlined type from which the discussed disadvantages are eliminated and which, in particular, makes possible a uniform deposition of sliver into a coiler can, particularly at elevated sliver advancing speeds.

This object and others to become apparent as the specification progresses, are accomplished by the invention, according to which, briefly stated, the apparatus for depositing sliver from a sliver-producing machine into a coiler can in an annular pattern includes two cooperating pressure rolls for advancing the sliver; a rotatably supported coiler head arranged for receiving sliver from the pressure rolls and having a sliver outlet travelling in a circular path upon rotation of the coiler head; a movable coiler can platform disposed below the coiler head for receiving a coiler can in an upright position; a drive for driving the pressure rolls, the coiler head and the coiler can platform for advancing sliver from the pressure rolls into the coiler head and for depositing sliver by the circulating sliver outlet into the coiler can moved by the coiler can platform in an annular pattern; and a control and regulating device connected to the drive for altering the angular velocity of the coiler head within revolutions thereof as a function of momentary positions of the sliver outlet on the circular path thereof.

By changing the rpm of the coiler head within revolutions, a uniform sliver deposition into the coiler can is ensured. Sliver depositing problems which are derived from the changing relative speeds during one sliver coil revolution, for example, during simultaneous linear motion of the can platform supporting a rectangular coiler can are reduced. Thus, the invention departs from the constant rpm rotation of the coiler head; rather, the angular velocity of the coiler head is altered according to a program as a function of the momentary location of the sliver outlet opening provided in the coiler head. Preferably, the alteration of rpm is performed within an order of magnitude which still corresponds to practical lags and, at the same time, makes possible the utilization of the sliver channel of the coiler head as an accumulator.

In case of small coiler head diameters the centrifugal forces are significantly greater than in case of large coiler head diameters, given the same sliver delivery speeds. For this reason, sliver depositing problems are significantly greater because the increased centrifugal force causes a sliver expansion (ballooning) which, however, can be compensated for by a lag correction. For this reason, the measures according to the invention may be particularly advantageously utilized when a coiler head of small diameter is used.

According to a further advantageous feature of the invention, an additional change of the coiler head rpm is effected as a function of the momentary location of the coiler can and/or as a function of the speed of the coiler can motion.

In accordance with still another advantageous feature of the invention, during travel of the sliver outlet of the coiler head in the same direction as the motion of the coiler can the rpm of the coiler head is reduced, whereas during motions in opposite directions the rpm of the coiler head is increased.

The apparatus according to the invention for depositing the sliver in an annular pattern into a coiler can includes a rotary coiler head which has its own drive, a control and regulating device with which the coiler head drive is connected and by means of which the angular velocity of the coiler head is varied within each revolution as a function of the momentary location of the sliver outlet provided in the coiler head.

The invention has the following additional advantageous features:

A separate drive is provided for moving the coiler can platform.

The coiler can platform is a rotary support designed for accommodating a cylindrical coiler can thereon.

The coiler can platform is reciprocated linearly and is designed to accommodate thereon a flat coiler can.

The angular velocity of the coiler head is changed within each revolution thereof as a function of the speed of the coiler can platform.

The coiler head has a small diameter of between 150 and 250 mm.

BRIEF DESCRIPTION OF THE DRAWINGS

FIG. 4 is a block diagram of a preferred embodiment of the invention associated with a drawing frame handling flat coiler cans.

FIG. 5 is a top plan view of a cylindrical coiler can containing sliver deposited in an annular pattern.

FIG. 6 is a top plan view of a flat coiler can containing sliver deposited in an annular pattern.

DESCRIPTION OF THE PREFERRED EMBODIMENTS

Figure 1:
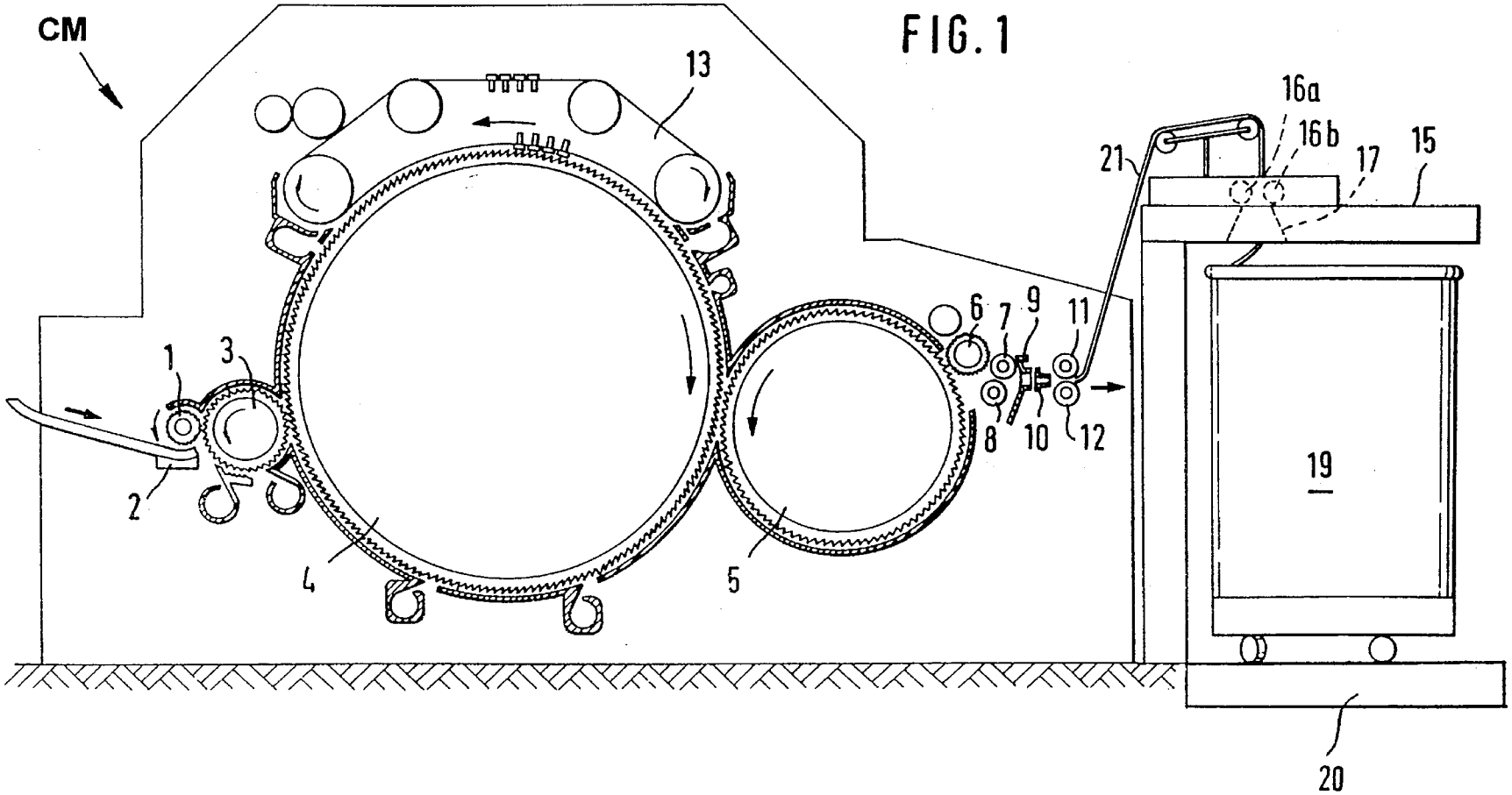
FIG. 1 is a schematic side elevational view of a carding machine incorporating the invention.
Figure 3:
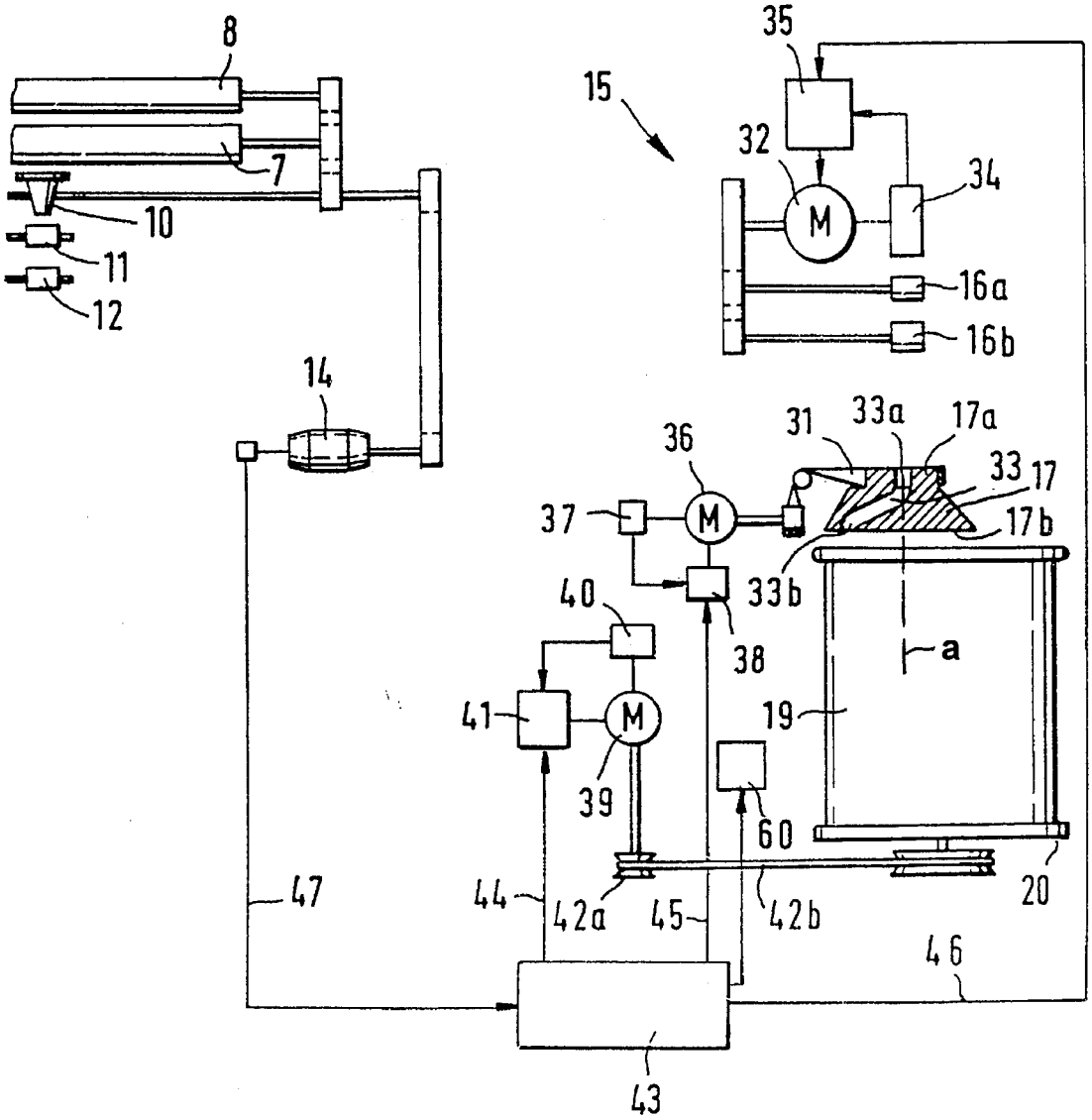
FIG. 3 is a block diagram of a preferred embodiment of the invention associated with a carding machine.

FIG. 1 shows a carding machine CM which may be an EXACTACARD DK 760 model, manufactured by Tr ützschler GmbH & Co. KG, Mönchengladbach, Germany. The carding machine has a feed roll 1, a feed table 2, a licker-in 3, a main carding cylinder 4, a doffer 5, a stripping roll 6, crushing rolls 7 and 8, a web guiding element 9, a sliver trumpet 10, delivery rolls (calender rolls) 11 and 12 as well as traveling flats 13. The delivery rolls 11 and 12, the crushing rolls 7 and 8, the stripping roll 6 and the doffer 5 are driven by a motor 14, as shown in FIG. 3. At the output side of the carding machine CM a sliver coiler 15 is arranged which includes two driven pressure rolls 16*a*, 16*b* and a driven coiler head 17. The cylindrical coiler can 19 is positioned on a driven coiler can platform 20.

Figure 2:
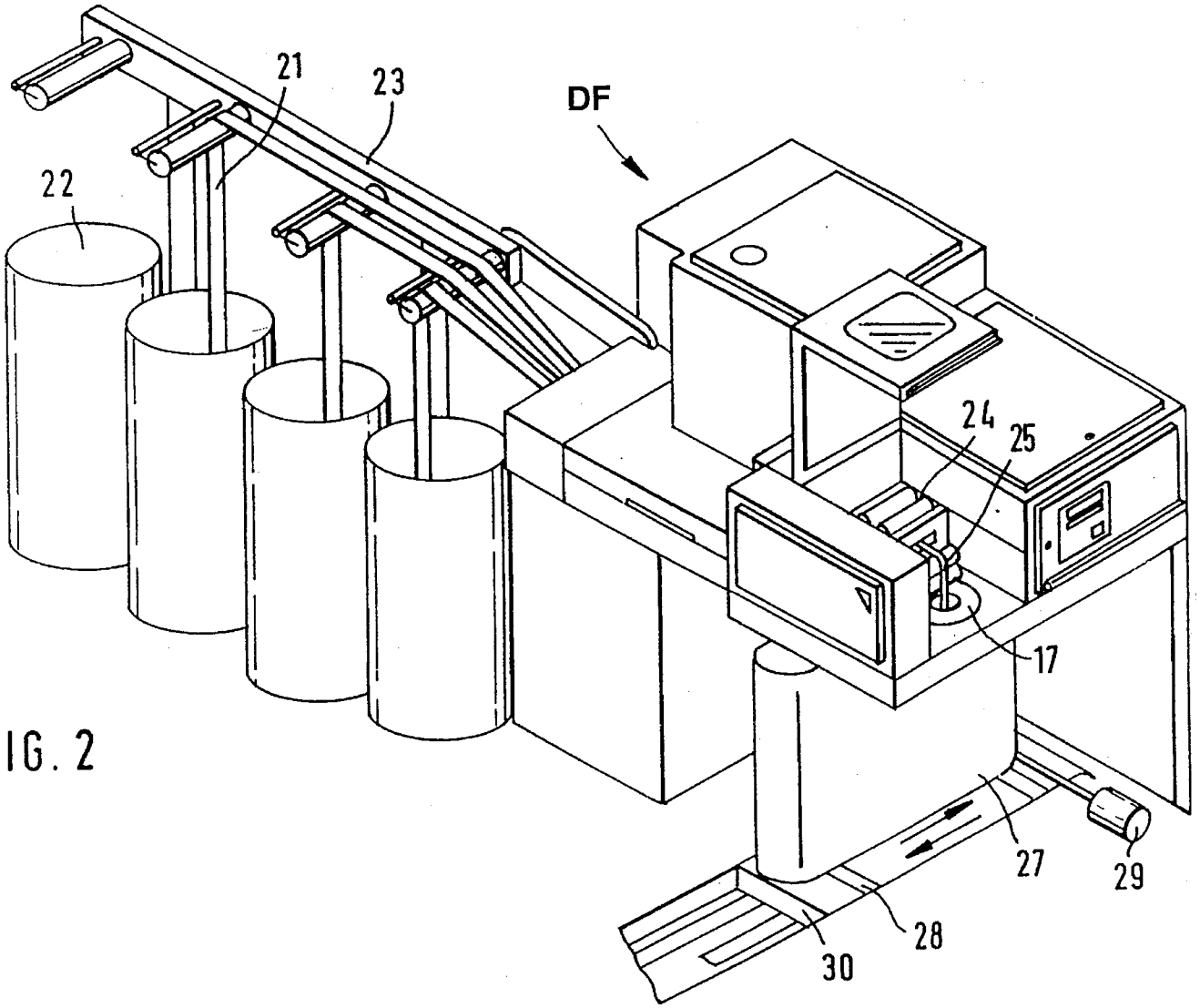
FIG. 2 is a schematic perspective view of a drawing frame incorporating the invention.

FIG. 2 illustrates a drawing frame DF which may be an HS 900 model high-performance drawing frame manufactured by Trützschler GmbH & Co. KG. Underneath the sliver input 23 of the drawing frame DF a plurality of cylindrical (round) coiler cans 22 are arranged and the sliver 21 is drawn from the cans 22 and advanced to the drawing unit 24 of the drawing frame DF. After passing through the drawing unit 24, the drafted sliver 25 is introduced into the coiler head 17 and is deposited thereby in an annular pattern into a flat coiler can 27. The flat coiler can 27 is positioned on a sled 28 which is reciprocated in the direction of the arrows by a shifting device 30 driven by a motor 29.

Turning to FIG. 3, the sliver 21 is advanced to the cooperating pressure rolls (calender rolls) 16*a*, 16*b*. The sliver originates from a sliver-producing spinning preparation machine such as a carding machine CM (FIG. 1) or a drawing frame DF (FIG. 2).

The coiler head 17 is supported for rotation about a vertical axis a and has a belt pulley 17*a* about which a drive belt 31 is trained to provide a driving torque. The coiler head 17 further has a lower plate 17*b* positioned above the coiler can 19 which, in turn, stands on the rotary platform 20. The coiler head 17 has an obliquely oriented sliver channel 33 having an inlet opening 33*a* oriented towards the pressure rolls 16*a*, 16*b* and an outlet opening 33*b* which is situated in the rotary plate 17*b* eccentrically to the vertical axis a of the coiler head 17. The coiler can 19 which may be conventionally provided with a vertically displaceable bottom pressed upwardly by a coil spring, stands on the can platform 20 which is rotatable about a vertical axes coinciding with the axis of the coiler can 19 standing thereon.

The pressure rolls 16*a*, 16*b* are driven by an electric motor 32 which has an rpm transmitter (tachometer) 34 connected to the electric motor 32 by an rpm control device 35. A further electric motor 36 drives the belt 31 to rotate the coiler head 17. The electric motor 36 too, is provided with an rpm transmitter (tachometer) 37 connected to the electric motor 36 by an rpm control device 38. An electric motor 39 drives the coiler can platform 20 by means of a drive pulley 42*a* and a drive belt 42*b*. The electric motor 39 has an rpm transmitter (tachometer) 40 coupled to the electric motor 39 by an rpm control device 41. According to this arrangement all three driving devices have their own rpm regulating circuit respectively formed of the electric motor 32, 36 and 39, the rpm transmitter 34, 37, and 40 as well as the rpm control device 35, 38 and 41.

The desired rpm values 44, 45, and 46 for the drive motors 39, 36 and 32, respectively, are calculated by a central control and regulating device 43 such as a microcomputer. The desired values 44, 45, and 46 are in a predetermined, variable relationship to the delivery speed value 47 of the sliver-producing machine. A conventional sliver severing device 60 is also connected to the control and regulating device to cut the sliver, for example, downstream of the sliver outlet 33*b* of the coiler head 17 when the desired fill level in the coiler can is reached.

When flat coiler cans 27 are used as shown in FIG. 2, they are linearly reciprocated underneath the coiler head 17 by the back-and-forth travelling sled 28.

In FIG. 4 an rpm transmitter 48 and an rpm control device 49 are associated with the drive motor 29 for the reciprocating device 30 of the sled 28 and are connected to the control and regulating device 43. In other respects, the sliver coiler at the outlet end of the drawing frame DF corresponds to the sliver coiler at the output end of the carding machine CM. It should be understood that at the output end of the drawing frame DF the sliver 25 may be deposited in a rotating cylindrical coiler can in which case the can is supported on a rotary platform 20 as shown in FIGS. 1 and 3.

FIGS. 5 and 6 show the annular pattern of the deposited sliver in a cylindrical coiler can 19 (FIG. 5) and in a flat coiler can 27 (FIG. 6).

Figure 7:
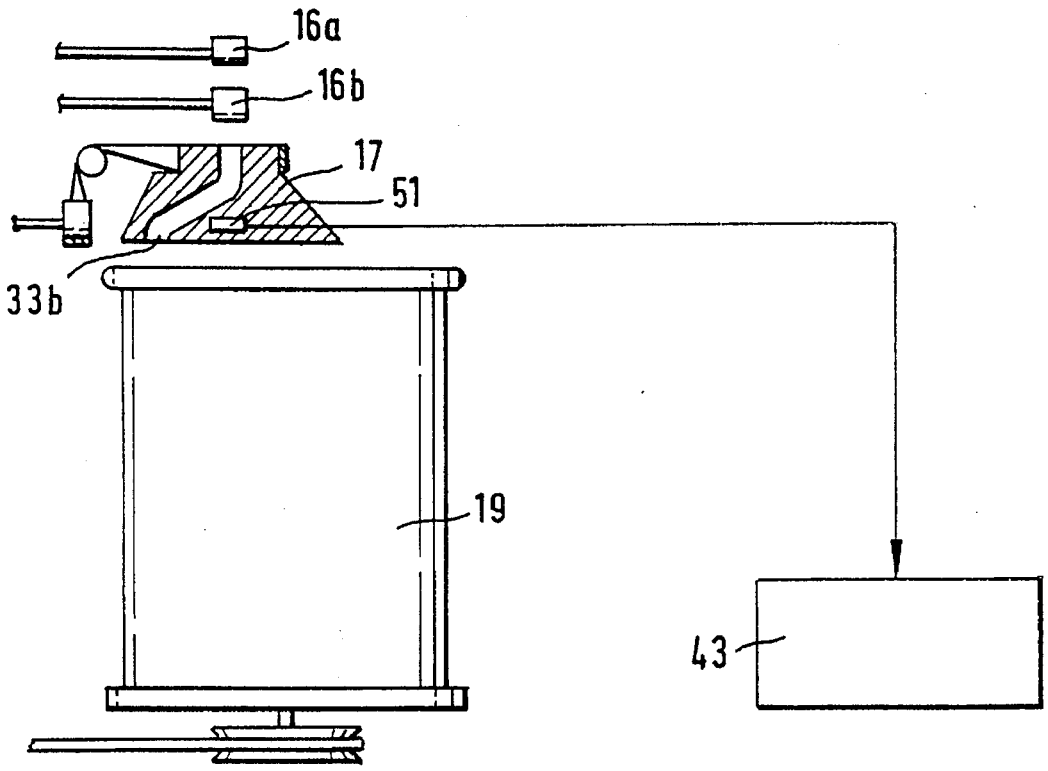
FIG. 7 is a schematic side elevational view of a coiler, a rotary coiler platform supporting a cylindrical coiler can and a position sensor associated with the coiler head.

Turning to FIG. 7, the coiler head 17 is provided with a sensor 51, for example, an incremental path sensor which is connected with the control and regulating device 43 to thus enable the latter to recognize any position of the sliver outlet 33*b* of the coiler head 17 on its circular path. The angular velocity of the coiler head 17 is changed by the motor 36 during each revolution thereof as a function of the position of the sliver outlet 33*b*. In this manner an undesired stretching or ballooning of the sliver is avoided.

It will be understood that the above description of the present invention is susceptible to various modifications, changes and adaptations, and the same are intended to be comprehended within the meaning and range of equivalents of the appended claims.

What is claimed is:

1. In a method of depositing sliver from a sliver-producing machine into a coiler can in an annular pattern, including the steps of advancing the sliver by cooperating pressure rolls into a coiler head having a sliver outlet;

rotating the coiler head with an angular velocity for causing the sliver outlet of the coiler head to travel in a circular path;

positioning and moving an upwardly open coiler can underneath the coiler head during the step of rotating the coiler head; and depositing sliver from the circularly travelling sliver outlet into the coiler can in an annular pattern during the step of moving the coiler can;

the improvement comprising the steps of (a) sensing and determining momentary positions of the sliver outlet on the circular path thereof; and (b) altering the angular velocity of the coiler head within revolutions thereof as a function of said momentary positions.

2. The method as defined in claim 1, wherein said step of altering includes the step of decreasing said angular velocity during codirectional movement of the coiler head and the coiler can and the step of increasing said angular velocity during movement of the coiler head and the coiler can in mutually opposite directions.

3. The method as defined in claim 1, wherein said step of altering includes the step of altering the angular velocity as a function of the speed of the coiler head.

4. The method as defined in claim 1, wherein said step of altering includes the step of altering the angular velocity as a function of the speed of the coiler can movement underneath the coiler head.

5. An apparatus for depositing sliver from a sliver-producing machine into a coiler can in an annular pattern, comprising (a) two cooperating pressure rolls for advancing the sliver;

(b) a rotatably supported coiler head arranged for receiving sliver from said pressure rolls; said coiler head having a sliver outlet travelling in a circular path upon rotation of said coiler head;

(c) a movable coiler can platform disposed below said coiler head for receiving a coiler can in an upright position;

(d) drive means for driving said pressure rolls, said coiler head and said coiler can platform for advancing sliver from said pressure rolls into said coiler head and for depositing sliver by the circulating sliver outlet into the coiler can moved by the coiler can platform in an annular pattern;

(e) a sensor supported at said coiler head for detecting momentary positions of said sliver outlet on the circular path thereof and for emitting signals representing the momentary positions; and (f) a control and regulating device connected to said drive means and said sensor and including means for altering the angular velocity of the coiler head within revolutions thereof as a function of said momentary positions of the sliver outlet.

6. The apparatus as defined in claim 5, wherein said drive means comprises a separate motor for rotating said coiler head.

7. The apparatus as defined in claim 5, wherein said coiler head has a diameter of 150–250 mm.

8. The apparatus as defined in claim 7, wherein said coiler can platform is rotatably supported and is arranged for receiving a cylindrical coiler can.

9. The apparatus as defined in claim 7, wherein said coiler can platform is linearly movably supported and is arranged for receiving a coiler can having a flat horizontal cross-sectional outline.

10. The apparatus as defined in claim 5, wherein said drive means comprises a separate motor for driving said coiler can platform.

* * * * *